United States Patent [19]

Bowles

[11] 4,103,632

[45] Aug. 1, 1978

[54] STEPPING MOTOR SHAFT POSITION DETERMINING ARRANGEMENT

[75] Inventor: Theodore L. Bowles, South Orange, N.J.

[73] Assignee: The Singer Company, New York, N.Y.

[21] Appl. No.: 843,763

[22] Filed: Oct. 20, 1977

[51] Int. Cl.[2] ..... D05B 3/02

[52] U.S. Cl. ..... 112/158 E; 318/685; 250/233

[58] Field of Search ..... 112/158 E, 121.12, 121.11, 112/275, 277; 318/685, 696; 250/233

[56] References Cited

U.S. PATENT DOCUMENTS

| | | | |
|---|---|---|---|
| 3,371,214 | 2/1968 | Berryman | 250/233 |
| 3,787,727 | 1/1974 | McSparran | 318/685 X |
| 3,815,531 | 6/1974 | Wurst et al. | 112/275 X |

FOREIGN PATENT DOCUMENTS

| | | | |
|---|---|---|---|
| 2,702,488 | 7/1977 | Fed. Rep. of Germany | 112/158 E |

*Primary Examiner*—Peter Nerbun

*Attorney, Agent, or Firm*—David L. Davis; Edward L. Bell; Robert E. Smith

[57] ABSTRACT

A sewing machine is disclosed wherein the positioning of the work feeding mechanism and the needle are controlled by respective stepping motors. The angular orientation of each stepping motor shaft determines the positioning of its respective mechanism. An array of sensing elements are utilized to define angular sectors within which the stepping motor shaft is deployed. The number of angular sectors is less than the total number of discrete angular orientations which may be assumed by the stepping motor shaft. The precise angular orientation of the stepping motor shaft is determined by combining information as to which angular sector the stepping motor shaft is in with information as to which set, or phase, of stepping motor coils is energized.

5 Claims, 6 Drawing Figures

STEPPING MOTOR SHAFT POSITION DETERMINING ARRANGEMENT

BACKGROUND OF THE INVENTION

This invention relates to sewing machines and, more particularly, to sewing machines employing stepping motors to control the placement of successive stitches to form a selected pattern.

In recent years, so called "electronic" sewing machines have gained in popularity and have met with commercial success in both industrial and domestic applications. These electronic sewing machines typically include a memory unit for storing in digital form information to control the placement of successive stitches to automatically produce a desired pattern. The stitch position coordinates may be controlled either by influencing the needle jogging and/or the work feeding or by influencing the travel of a work holder relative to the path of needle reciprocation. Sgnals generated from the stored information are applied to signal responsive actuators for selectively positioning the needle and the work feeding mechanism. These actuators may be of either the analog type or the digital type. An analog actuator is responsive to an analog signal for positioning its associated mechanism at a point along a continuum between two extreme positions. The present invention is concerned with digital actuators wherein the actuator responds to digital input signals to position its associated mechanism at a selected one of a plurality of incrementally displaced discrete points between two extreme positions. In particular, the present invention is directed to such sewing machines wherein the digital actuator includes a stepping motor, the angular orientation of the stepping motor shaft controlling the associated mechanism.

Typically, stepping motors are run in an open loop mode, that is, the different coil pairs of the stepping motor are sequentially energized a predetermined number of times to incrementally change the angular position of the rotor and hence the angular position of the output shaft connected to the rotor. However, the precise angular orientation of the shaft cannot be uniquely determined by knowing which particular set of coils is energized, because for each coil pair energization, the rotor may be aligned with the coil pair in either a first orientation or a second orientation angularly displaced 180° from the first angular orientation. In stepping motors having multiple sets of coil pairs within a phase, the ambiguity of the angular orientation of the rotor is even greater.

It is therefore an object of this invention to provide an arrangement for determining the precise angular orientation of a stepping motor output shaft.

Shaft encoders per se are well known in the prior art for determining the angular orientation of a shaft. These shaft encoders typically include a plurality of sensing elements responsive to cooperating indicia on the shaft and decoding circuitry responsive to outputs from the sensing elements. These shaft encoders perform their desired function satisfactorily. However, economies can be achieved by reducing the number of sensing elements utilized. Since with a stepping motor some information is already available, i.e., which coils are energized, it would be desirable to utilize the available information to provide a more economical shaft position determining arrangement.

It is therefore another object of this invention to provide a stepping motor shaft position determining arrangement employing a reduced number of sensing elements.

SUMMARY OF THE INVENTION

The foregoing and additional objects are attained in accordance with the principles of this invention in a sewing machine having at least one stitch forming instrumentality variable in position over a predetermined range of possible positions between successive stitches to produce a predetermined pattern of stitches, a stepping motor including a shaft operatively connected to impart movement to the stitch forming instrumentality over the predetermined range of positions, the stepping motor including a rotor member fixedly connected to the shaft and a plurality of diametrically opposed coil pairs circumferentially disposed about the shaft, and control means responsive to stitch pattern signals applied thereto for selectively and sequentially energizing the stepping motor coil pairs so as to move the rotor in discrete angular increments, by providing means for sensing which one of a plurality of defined angular sectors the shaft is in, the plurality of defined angular sectors being less than the number of discrete angular orientations which the shaft can assume, and means responsive to the sensing means and to a signal from the control means representative of which of the plurality of coil pairs is energized for determining the angular orientation of the shaft.

BRIEF DESCRIPTION OF THE DRAWINGS

The foregoing will be more readily apparent upon reading the following description in conjunction with the drawings in which.

DETAILED DESCRIPTION OF THE PREFERRED EMBODIMENT

Figure 1:
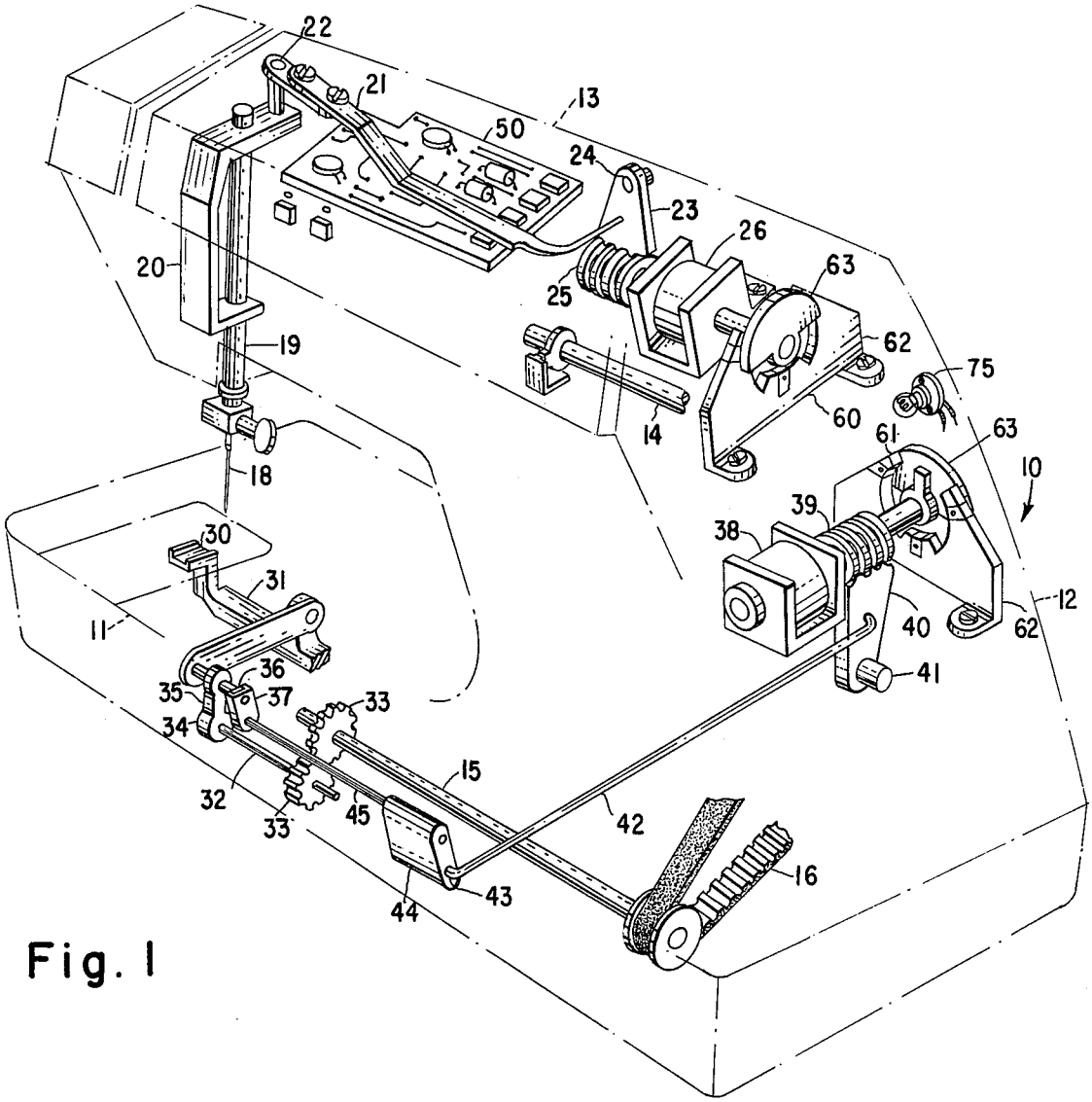
FIG. 1 is a perspective view of a sewing machine including fragments of typical sewing needle and work feeding mechanisms controlled by respective stepping motors and which form an environment for apparatus constructed in accordance with the principles of this invention.

FIG. 1 of the drawings illustrates a sewing machine with fragments of two mechanisms shown thereon, the needle and the work feeding mechanism, which can contribute to changes in the relative coordinates of successive needle penetrations. As shown in phantom lines in FIG. 1, the sewing machine casing 10 includes a bed 11, a standard 12 rising from the bed and a bracket arm 13 overhanging the bed. The driving mechanism of the sewing machine includes an arm shaft 14 and a bed shaft 15 interconnected by a timing belt 16 in the standard. A timing belt 16 is driven by the main drive motor (not shown) of the sewing machine. A needle 18 carried for endwise reciprocation by a needle bar 19 is mounted for lateral jogging movement in a gate 20 in the bracket arm 13. Any conventional connections (not shown) may be used between the arm shaft and the needle bar for imparting needle reciprocation. A drive link 21 pivoted at 22 to the gate 20 serves to impart lateral jogging movement to the needle 18. The drive link 21 is connected to a gear segment 23 which is pivoted at 24 to the machine casing. The gear segment 23 meshes with a worm 25 which is carried on an extension of the shaft of a stepping motor 26. Rotation of the stepping motor 26 causes rotation of the worm 25 and the consequent pivoting of the worm gear segment 23, which controls the position of the link 21 and hence the lateral position of the needle 18.

Also illustrated in FIG. 1 is a fragment of a work feeding mechanism including a feed dog 30 carried by a feed bar 31. In FIG. 1, a mechanism is illustrated for imparting work transporting movement to the feed dog 30 including a feed drive shaft 32 driven by gears 33 from the bed shaft 15, a cam 34 on the feed drive shaft 32, a pitman 35 embracing the cam 34 and connected to reciprocate a slide block 36 in a slotted feed regulating guideway 37. A link **37*a* pivotally connects the pitman 35 with the feed bar 31 so that depending upon the inclination of the guideway 37, the magnitude and direction of the feed stroke of the feed dog 30 will be determined. The inclination of the guideway 37 is controlled by a stepping motor 38, a worm 39 being carried on an extension of the shaft of stepping motor 38. Meshed with the worm 39 is a worm gear segment 40 pivoted at 41 to the machine casing. Connected to the worm gear segment 40 is a link 42 pivoted at 43 to a rock arm 44 carried on a rock shaft 45 secured to the guideway 37. Rotation of the stepping motor 38 causes rotation of the worm 39 and the consequent pivoting of the worm gear segment 40, which controls the position of the link 42 and the inclination of the guideway 37**.

Also shown in FIG. 1 is a printed circuit board 50 which illustratively has mounted thereon memory units for storing stitch pattern information and control circuitry for operating the stepping motors 26 and 38 in accordance with the stored information. The circuitry on the board 50 will not be described in any greater detail than is necessary for an understanding of the principles of this invention and such explanation will be given in conjunction with a description of the block diagram of FIG. 6.

In accordance with the principles of this invention, associated with each of the stepping motors 26 and 38 is a respective sensor assembly 60 and 61, identical in construction. These sensor assemblies will be described in greater detail hereinafter with respect to a description of FIGS. 4 and 5. However, at this point, all that need be said is that each of the sensor assemblies includes a sensor support 62 fixedly mounted to sewing machine casing 10 in a conventional manner and a shutter element 63 fixedly mounted on, and adapted for rotation with, the shaft of its respective stepping motor.

Figure 2:
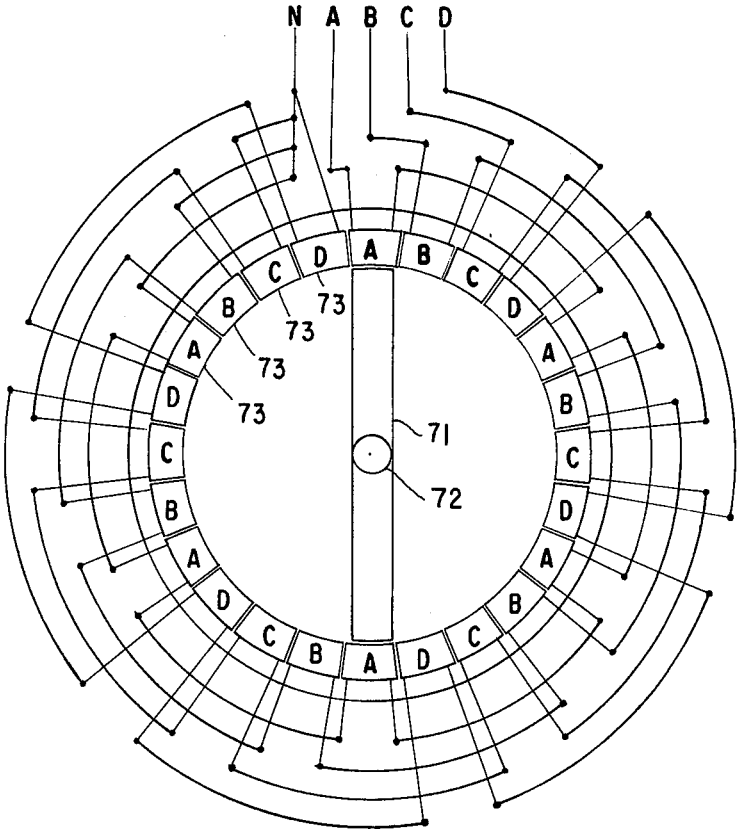
FIG. 2 schematically depicts the rotor and coil arrangement of an illustrative 24 position four phase stepping motor.

The present invention may be utilized in conjunction with any stepping motor. However, for purposes of illustration, the present invention will be described with respect to a 24 position four phase stepping motor. As schematically depicted in FIG. 2, the illustrative 24 position four phase stepping motor includes a rotor element 71 mounted on a shaft 72 and 24 coils 73 arranged in four phases. The coils 73 are circumferentially disposed about shaft 72 at equally spaced angular increments of 15 degrees. The 24 coils are divided into four phases, denominated A, B, C and D, with the phases alternating around the rotor, so as to be interleaved. The respective coils of each phase are interconnected so as to be simultaneously energized. As shown in FIG. 2, the stepping motor illustratively has 5 leads extending therefrom, one for each of the phases A, B, C and D, and a neutral (N) lead which is common to all of the phases. The coils within each of the phases are serially interconnected so that when an energizing voltage is applied to terminal A, current flows through all of the coils within phase A and out through the common lead N, energizing all of the coils of phase A. Similarly, when an energizing voltage is applied to terminal B, C or D, all of the corresponding coils will be energized. Rotor 71 is constructed of a magnetic material so that when current flows through a coil phase, setting up a magnetic field, forces are imposed upon rotor 71 to align rotor 71 across an opposed pair of energized coils in order to complete a magnetic circuit. It is to be noted at this point that, although not shown in FIG. 2 for the sake of clarity, a return path for the magnetic circuit is provided external to all the coils. When it is desired to move the rotor 71, such movement must take place in fixed angular increments corresponding to the displacement between adjacent coils, and the coil phases must be energized sequentially. The reason for the sequential energization of coil phases is as follows. Looking at FIG. 2, it is seen that with the rotor 71 positioned opposite coil pairs of phase A, if the coils of phase C were to be energized, the resultant magnetic field would create equal and opposite forces tending to rotate the rotor 71 both clockwise and counterclockwise. Thus, assuming ideal and equal conditions, the rotor 71 would not change position. Likewise, if the coils of phase A were to be energized again, the rotor 71 would not move. Therefore, only energization of phases B or D would cause rotation of the rotor 71. Thus, if it were desired to rotate the rotor 71 by 90° in the clockwise direction, this would have to be done in six successive steps by first energizing the coils of phase B, then phase C, then phase D, then phase A, then phase B, and finally phase C.

It is further seen from an examination of FIG. 2 that energization of any phase can result in six possible angular orientations of the rotor. It is therefore apparent that merely knowing which phase of coils is energized is not sufficient to determine the precise angular orientation of the rotor 71.

Figure 3:
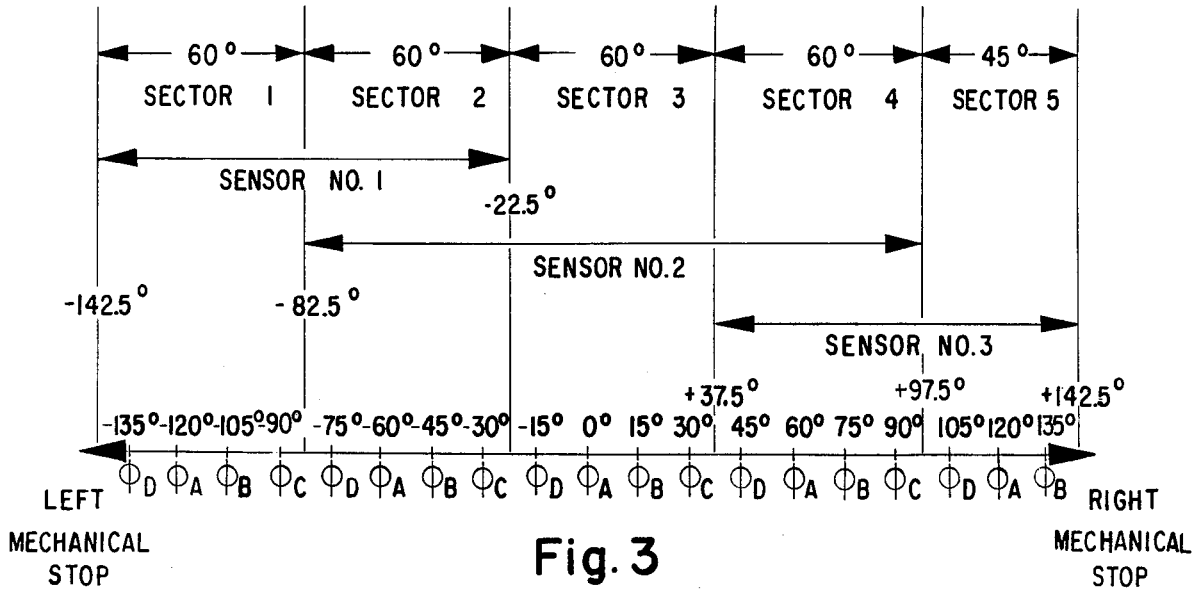
FIG. 3 illustrates the relationships between the defined angular sectors, the stepping motor phases and the sensor elements in accordance with the principles of this invention.

Referring now to FIG. 3, in accordance with the principles of this invention, the allowable rotational range of the rotor 71 is divided into five angularly defined sectors. For the particular environment utilized herein to describe the principles of this invention, the vertical orientation of the rotor 71 as shown in FIG. 2 is defined as zero degrees and the rotor 71 is constrained by mechanical stops, in a manner to be described hereinafter, to only move 142.5° in either the clockwise or the counterclockwise direction, the clockwise direction being defined as the positive angular direction. As shown in FIG. 3, sector #1 is from minus 142.5° to minus 82.5°; sector #2 is from minus 82.5° to minus 22.5°; sector #3 is from minus 22.5° to plus 37.5°; sector #4 is from plus 37.5° to plus 97.5°; and sector #5 is from plus 97.5 ° to plus 142.5°. Within each angularly defined sector, a coil phase is represented only once. Therefore, knowing which sector the rotor 71 is in and which coil phase is energized provides sufficient information to determine the precise angular orientation of the rotor 71, and consequently the precise angular orientation of the shaft of the stepping motor to which it is connected. It should be noted at this point that the end points of the defined sectors lie between the possible discrete orientations of the rotor. This is to avoid ambiguity at these end points.

Figure 4:
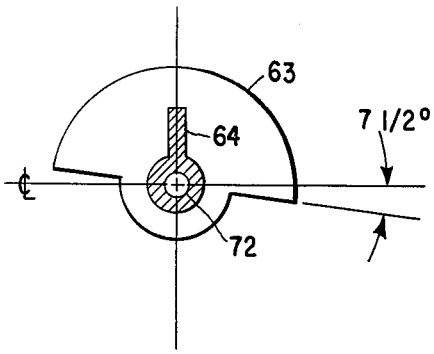
FIG. 4 depicts an illustrative shutter element adapted to be mounted on the stepping motor shaft for cooperation with the sensor support shown in FIG. 5.
Figure 5:
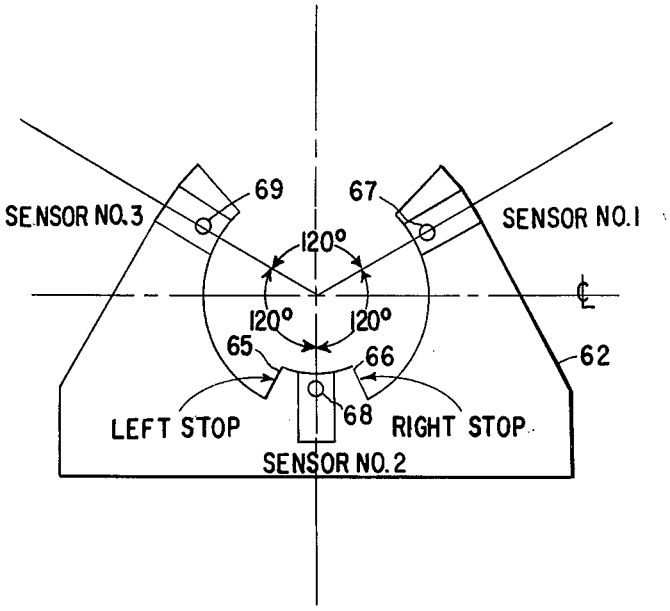
FIG. 5 depicts an illustrative construction of a sensor support constructed in accordance with the principles of this invention.

In order to determine which sector the rotor is in, the sensor assembly illustrated in FIGS. 4 and 5 is utilized. The sensor assembly includes a shutter 63 mounted on the shaft 72 and adapted to rotate therewith. The shutter 63 also includes a projection 64 which cooperates with a left stop 65 and a right stop 66 of the sensor assembly 62 (FIG. 5) to limit the travel to the range indicated in FIG. 3. In FIG. 4, the shutter 63 is shown in the position it assumes with the rotor 71 at zero degrees. The shutter 63 has an enlarged area covering 180° of arc and it is noted that in the zero degree angular orientation of rotor 71 the enlarged area of the shutter 63 is offset 7.5° from the horizontal. This is to insure that the defined angular sectors will lie intermediate the possible positions of the rotor, as described hereinabove. The shutter 63 cooperates with the sensor assembly 62 (FIG. 5). The sensor assembly 62 is fixedly secured within the sewing machine case 10 and has mounted thereon a first sensor element 67, a second sensor element 68, and a third sensor element 69. These three sensor elements are equally displaced at 120° intervals, with the second sensor element 68 lying on a vertical axis. Illustratively, the three sensor elements 67, 68, and 69 are light sensitive devices such as for example, photocells, phototransistors, or the like. The shutter 63 either covers these sensors or exposes them to light emanating from a light bulb 75 (FIG. 1) within the sewing machine case. (While a common light bulb 75 has been depicted for the sake of clarity, it is apparent that each sensor assembly may have its own dedicated light source. Further, each individual sensor may have its own dedicated light source.)

The shutter 63 is mounted on the shaft 72 of the stepping motor and as the shaft turns, the shutter 63 covers up or exposes various combinations of the sensors 67, 68 and 69 in such a way as to indicate which sector the rotor 71 is in. Illustratively, these combinations are as set forth in the following Table I.

Table I

| Sector | Sensor | | | |
|---|---|---|---|---|
| | 67 | 68 | 69 | O=Sensor exposed |
| 1 | 0 | X | X | X=Sensor covered |
| 2 | 0 | 0 | X | |
| 3 | X | 0 | X | |
| 4 | X | 0 | 0 | |
| 5 | X | X | 0 | |

It is understood that while light sensitive sensors have been described above, other sensing elements or tranducers such as magnetic sensors for example, may be utilized as well. Of course, in such case, the shutter 63 would be replaced with a proper cooperating member dependent upon the type of transducer utilized as the sensing element.

Figure 6:
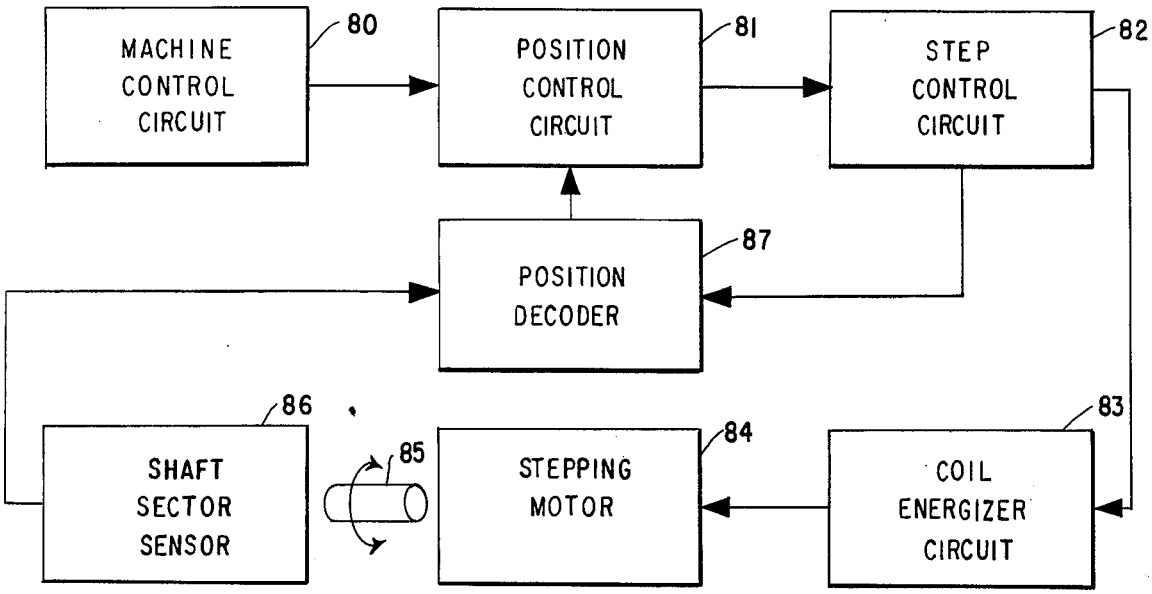
FIG. 6 is a block diagram of an illustrative closed loop control system for operating a stepping motor in accordance with the principles of this invention.

Referring now to FIG. 6, shown therein is a block diagram illustrating how the principles of this invention may be utilized to provide a closed loop stepping motor control system. The elements within the individual blocks in FIG. 6 comprise conventional digital logic well known in the art and only as much detail will be given as is necessary for an understanding of this invention. A machine control circuit 80 provides to a position control circuit 81 signals indicative of the angular position that the rotor is to assume. These signals are illustratively derived from a memory within the machine control circuit 80, which memory includes instructions for controlling the appropriate stitch forming mechanism of the sewing machine in accordance with a predetermined desired pattern. The position control circuit 81 then applies signals to a step control circuit 82 indicative of how many steps and in which direction the stepping motor is to be moved. The step control circuit 82 then causes the sequential energization of the coil phases by supplying appropriate signals to a coil energizer circuit 83. The signals supplied to the coil energizer circuit 83 from the step control circuit 82 are representative of which coil phase is to be energized. The coil energizer circuit 83 then energizes the appropriate coil phase in the stepping motor 84. The stepping motor 84 then repositions its shaft 85. A shaft sector sensor 86, constructed in accordance with the principles of this invention and illustratively as depicted in FIGS. 4 and 5, then provides signals to a position decoder 87 as to which angular sector the shaft 85 is in. The position decoder 87 also receives from the step control circuit 82 information signals as to which coil phase is energized. By means of simple combinational logic, the position decoder 87 can then determine the precise angular orientation of the shaft 85. The position decoder 87 is constructed of simple combinational logic to decode Table II below.

Table II

| Sensor | | | Phase | | | | |
|---|---|---|---|---|---|---|---|
| 67 | 68 | 69 | A | B | C | D | Position |
| X | | | | | | X | −135° |
| X | | | X | | | | −120° |
| X | | | | X | | | −105° |
| X | | | | | X | | − 90° |
| X | X | | | | | X | − 75° |
| X | X | | X | | | | − 60° |
| X | X | | | X | | | − 45° |
| X | X | | | | X | | − 30° |
| | X | | | | | X | − 15° |
| | X | | X | | | | − 0° |
| | X | | | X | | | − 15° |
| | X | | | | X | | − 30° |
| | X | X | | | | X | − 45° |
| | X | X | X | | | | − 60° |
| | X | X | | X | | | − 75° |
| | X | X | | | X | | − 90° |
| | | X | | | | X | −105° |
| | | X | X | | | | −120° |
| | | X | | X | | | −135° |

The precise angular orientation of the shaft 85 as determined by the position decoder 87 can then be utilized by the position control circuit 81 to ensure that the stepping motor 84 has been properly positioned. Thus, a closed loop stepping motor control system may be simply and efficiently implemented.

Accordingly, there has been described an arrangement for determining the precise angular orientation of a stepping motor output shaft utilizing a reduced number of sensing elements by advantageously utilizing information necessary to control the stepping motor. It is understood that the above-described arrangement is merely illustrative of the application of the principles of this invention. Numerous other arrangements may be devised by those skilled in the art without departing from the spirit and scope of this invention, as defined by the appended claims.

Having thus set forth the nature of this invention, what is claimed herein is:

1. In a sewing machine having at least one stitch forming instrumentality variable in position over a predetermined range of possible positions between successive stitches to produce a predetermined pattern of stitches, a stepping motor including a shaft operatively connected to impart movement to said stitch forming instrumentality over said predetermined range of positions, said stepping motor including a rotor member fixedly connected to said shaft and a plurality of diametrically opposed coil pairs circumferentially disposed about said shaft, and control means responsive to stitch pattern signals applied thereto for selectively and sequentially energizing said stepping motor coil pairs so as to move said rotor in discrete angular increments, the improvement comprising means for sensing which one of a plurality of defined angular sectors said shaft is in, said plurality of defined angular sectors being less than the number of discrete angular orientations which said shaft can assume, and means responsive to said sensing means and to a signal from said control means representative of which of said plurality of coil pairs is energized for determining the angular orientation of said shaft.

2. The sewing machine according to claim 1 wherein said sensing means includes:

a support member fixedly secured to the sewing machine;

a plurality of transducer elements mounted at spaced locations on said support member; and a cooperating member mounted on said stepping motor shaft for rotation therewith, said cooperating member causing the operation of different combinations of said transducing elements dependent on the angular orientation of said shaft.

3. The sewing machine according to claim 2 further including a source of light and wherein said transducing elements comprise light responsive devices and said cooperating member comprises a shutter which covers and exposes different combinations of said light responsive devices from said source of light dependent upon the angular orientation of said shaft.

4. The sewing machine according to claim 3 wherein said sensing elements include three light responsive devices disposed at equal angular increments about the axis of said shaft and said shutter covers a contiguous region extending 180° around the axis of said shaft.

5. The sewing machine according to claim 1 wherein said stepping motor includes a plurality of coils disposed at equal angular intervals around said shaft, said coils being interconnected in a plurality of groups of said coils, the coils being interleaved with respect to said groups around said shaft, and wherein each of said plurality of defined angular sectors includes therein no more than one coil of each of said groups.

* * * * *